US007947168B2

(12) United States Patent
Machin et al.

(10) Patent No.: US 7,947,168 B2
(45) Date of Patent: May 24, 2011

(54) SEGREGATION OF STREAMS FOR THE PRODUCTION OF AMMONIA

(75) Inventors: John Machin, Fort McMurray (CA); Daniel Rusnell, Fort McMurray (CA); Paul Won, Calgary (CA); Monica Morphy, Sherwood Park (CA); Xin Alex Wu, Edmonton (CA); Brenda Crickmore, Sherwood Park (CA); Craig McKnight, Sherwood Park (CA)

(73) Assignee: Syncrude Canada Ltd., Fort McMurray (CA)

( * ) Notice: Subject to any disclaimer, the term of this patent is extended or adjusted under 35 U.S.C. 154(b) by 333 days.

(21) Appl. No.: 12/042,960

(22) Filed: Mar. 5, 2008

(65) Prior Publication Data

US 2009/0223869 A1 Sep. 10, 2009

(51) Int. Cl.
*C10G 45/00* (2006.01)

(52) U.S. Cl. ..... 208/254 R; 208/50; 208/53; 208/108; 208/113; 208/208 R; 208/236; 423/210; 423/235; 423/237; 423/242.1

(58) Field of Classification Search ..... 208/254 R
See application file for complete search history.

(56) References Cited

U.S. PATENT DOCUMENTS

| | | | | |
|---|---|---|---|---|
| 3,335,071 | A | | 8/1967 | Bollen et al. |
| 3,383,173 | A | | 5/1968 | Bollen |
| 3,536,613 | A | | 10/1970 | Kunin et al. |
| 3,600,283 | A | | 8/1971 | Bollen et al. |
| 3,853,744 | A | * | 12/1974 | Lahn ..... 208/127 |
| 3,859,200 | A | * | 1/1975 | Brunn et al. ..... 208/216 R |
| 3,984,316 | A | | 10/1976 | Worrall et al. |
| 4,002,565 | A | | 1/1977 | Farrell et al. |
| 4,414,103 | A | * | 11/1983 | Farrell ..... 208/212 |
| 4,486,299 | A | | 12/1984 | Kettinger |
| 4,690,807 | A | * | 9/1987 | Saleem ..... 423/243.06 |
| 5,320,746 | A | | 6/1994 | Green et al. |
| 5,362,458 | A | | 11/1994 | Saleem et al. |
| 5,770,046 | A | * | 6/1998 | Sudhakar ..... 208/216 R |
| 6,746,596 | B2 | * | 6/2004 | Chung et al. ..... 208/53 |

FOREIGN PATENT DOCUMENTS

| | | |
|---|---|---|
| CA | 1022728 | 12/1977 |
| CA | 1185416 | 4/1985 |
| CA | 2116949 | 9/1994 |
| CA | 2180110 | 5/1996 |
| CA | 2343640 | 3/2000 |
| CA | 2344494 | 3/2000 |
| CA | 2371004 | 11/2000 |
| CA | 2384872 | 3/2001 |

* cited by examiner

*Primary Examiner* — Glenn A Caldarola
*Assistant Examiner* — Michelle L Stein
(74) *Attorney, Agent, or Firm* — Bennett Jones LLP

(57) ABSTRACT

A method for recovering $NH_3$ present in a sour water stream containing odiferous compounds such as pyridines, indoles, ketones and mercaptans produced during an upgrading process for upgrading bitumen from oil sands into synthetic crude comprising treating the sour water stream in a sour water treatment unit to produce a $NH_3$-rich stream and a $H_2S$-rich stream; and hydrotreating the $NH_3$-rich stream in a hydrotreater in the presence of hydrogen to remove the odiferous compounds such as pyridines, indoles, ketones and mercaptans and produce a treated $NH_3$-rich stream.

18 Claims, 2 Drawing Sheets

SEGREGATION OF STREAMS FOR THE PRODUCTION OF AMMONIA

FIELD OF THE INVENTION

The present application relates to a method for recovering ammonia present in a sour water stream containing odiferous compounds such as pyridines, indoles, ketones and mercaptans produced during an upgrading process for upgrading bitumen from oil sands into synthetic crude. The present application further relates to a method of upgrading bitumen wherein ammonia present in waste streams produced during the upgrading of bitumen is recovered and used to remove $SO_2$ from flue gas prior to its release into the atmosphere, thereby resulting in an upgrading method that is more self-subsistent.

BACKGROUND OF THE INVENTION

Oil sand deposits such as those found in the Athabasca Region of Alberta, Canada, contain a significant amount of heavy oil or bitumen. One recovery method that has been successful in extracting the heavy oil or bitumen from oil sand is commonly referred to as the hot water process and involves the liberation of the bitumen from the sand by forming oil sand slurry with hot water and separating the bitumen by froth flotation to form a bituminous froth. The bitumen present in the froth is then concentrated by diluting it with a solvent such as naphtha after which the diluted froth is centrifuged to remove substantially all of the water and mineral solids. Naphtha is then removed and the bitumen is ready for further upgrading to produce a synthetic crude oil.

Bitumen is a complex and viscous mixture of large or heavy hydrocarbon molecules which contain a significant amount of sulfur, nitrogen and oxygen. In order for bitumen to be processed in refineries, it must first be broken up into smaller hydrocarbon molecules (synthetic crude oil). Unlike the more useful smaller hydrocarbon molecules, bitumen is carbon rich and hydrogen poor. Thus, upgrading of bitumen to synthetic crude oil generally involves removing some carbon while adding additional hydrogen to make more valuable hydrocarbon products. This is generally done using four main processes: coking, which removes carbon and breaks large bitumen molecules into smaller parts; distillation, which sorts mixtures of hydrocarbon molecules into their components; catalytic conversions, which help transform hydrocarbons into more valuable forms; and hydrotreating, which is used to help remove sulfur and nitrogen and add hydrogen to molecules. The synthetic crude oil end product can then be further refined into jet fuels, gasoline and other petroleum products.

As mentioned, a useful process for upgrading bitumen is delayed or fluid coking. With fluid coking, the bitumen feedstock is introduced into a fluid coker reactor containing a fluidized bed of hot solids, preferably coke, and is distributed uniformly over the surfaces of the coke particles where it is cracked to vapors and to carbonaceous material which is deposited onto the particles. The vapors pass through cyclones which remove most of the entrained coke particles. The vapor is then discharged into a scrubbing zone where remaining coke particles are removed and the products are cooled to condense heavy liquids.

The coke particles in the coking zone flow downwardly to a stripping zone at the base of the coker reactor where a stripping gas, such as steam, is used to remove interstitial product vapors from, or between, the coke particles, as well as some adsorbed liquids from the coke particles. The coke particles are then removed to a burner where sufficient air is injected for burning at least a portion of the coke and heating the remainder sufficiently to satisfy the heat requirements of the coking zone where the unburned hot coke is recycled. Net coke, above that consumed in the burner, is withdrawn as product coke.

Coking produces a large amount of "sour water", so called because of the large amount (e.g., between 0.3 and 10.4 wt %) of hydrogen sulfide ($H_2S$) present therein. Also present in the sour water is a large amount (e.g., between 0.3 and 6.0 wt %) of ammonia ($NH_3$). Another process for upgrading bitumen is catalytic cracking, which also produces sour water having significant quantities of $H_2S$ and $NH_3$. Catalytic cracking involves the use of catalytic crackers operated at moderately-high temperatures (e.g., 400-500° C.), where a catalyst such as a zeolite catalyst is added to aid in "cracking" or splitting the large hydrocarbon molecules into smaller hydrocarbon molecules. It would be desirable to be able to recover the $NH_3$ present in either coking sour water or catalytic cracking sour water, as $NH_3$ is a valuable and useful product.

For example, during typical fluid coking operations, fuel gas produced in the coker burner is typically treated in a CO burner. However, the flue gas that is produced in the CO burner contains high levels of $SO_2$ and thus it is undesirable to release the flue gas directly into the atmosphere without addressing the high levels of $SO_2$ first. One process that may be used to remove $SO_2$ from flue gas is flue gas desulfurization, which process uses anhydrous or aqueous ammonia which reacts with the $SO_2$ to produce ammonium sulfate (see, for example, Canadian Patent No. 2,343,640, U.S. Pat. No. 4,690,807 and U.S. Pat. No. 5,362,458). The ammonium sulfate so produced can then be used as a fertilizer. Thus, flue gas desulfurization not only removes the $SO_2$ present in the flue gas but also produces a valuable byproduct, namely, ammonium sulfate.

However, significant quantities of $NH_3$ are needed in flue gas desulfurization, which can prove to be very costly. Thus, it would be desirable to recover $NH_3$ from sour water streams produced during bitumen upgrading to synthetic crude that is of a sufficient quality so that it could be used in such a process. It is understood, however, that the $NH_3$ recovered from sour water streams could also be used directly to make other useful products such as fertilizers and the like.

SUMMARY OF THE INVENTION

In one broad aspect, the present application relates to a method for recovering $NH_3$ present in a sour water stream containing odiferous compounds such as pyridines, indoles, ketones and mercaptans produced during an upgrading process for upgrading bitumen from oil sands into synthetic crude, comprising:

treating the sour water stream in a sour water treatment unit to produce a $NH_3$-rich stream and a $H_2S$-rich stream; and hydrotreating the $NH_3$-rich stream in a hydrotreater in the presence of hydrogen to remove the odiferous compounds such as pyridines, indoles, ketones and mercaptans and produce a treated $NH_3$-rich stream.

In one embodiment, the sour water stream is produced during a fluid coking operation. In another embodiment, the sour water stream is produced during a catalytic cracking operation. In another embodiment, the odiferous compounds are ketones such as acetone and 4-mercapto-4-methyl-2-pentanone.

In one embodiment, the method further comprises:

removing other impurities such as residual $H_2S$ from the treated $NH_3$-rich stream in an ammonia purification unit to produce cleaned $NH_3$.

In another embodiment, the method further comprises:

treating the treated $NH_3$-rich stream in a second sour water treatment unit prior to ammonia purification in the ammonia purification unit.

The cleaned $NH_3$ that is recovered from the sour water produced during a fluid coking operation by the above method can be used to treat $SO_2$-rich flue gas that is also produced in such operation. Thus, in another aspect, a method for recovering $NH_3$ present in a sour water stream containing odiferous compounds such as pyridines, indoles, ketones and mercaptans produced during a bitumen upgrading process is provided, comprising:

feeding the bitumen to a fluid coking unit comprising a fluidized bed coker, a coke burner and a CO burner, and producing a hydrocarbon product stream, the sour water stream, and a $SO_2$-rich flue gas stream;

treating the sour water stream in a sour water treatment unit to produce a $NH_3$-rich stream and a $H_2S$-rich stream;

hydrotreating the $NH_3$-rich stream in a hydrotreater in the presence of hydrogen to remove the odiferous compounds such as pyridines, indoles, ketones and mercaptans and produce a treated $NH_3$-rich stream;

removing other impurities such as residual $H_2S$ from the treated $NH_3$-rich stream in an ammonia purification unit to produce cleaned $NH_3$; and treating the $SO_2$-rich flue gas stream with the cleaned $NH_3$ in a flue gas desulfurization unit to remove $SO_2$ from the flue gas stream and produce ammonium sulfate.

In another aspect of the present application, a bitumen upgrading process is provided, wherein ammonia from segregated sour water streams produced during upgrading is recovered, comprising:

feeding the bitumen to a fluid coking unit comprising a fluidized bed coker, a coke burner and a CO burner, and producing a first hydrocarbon product stream, a first sour water stream and a $SO_2$-rich flue gas stream;

hydrotreating the first hydrocarbon product stream in a first hydrotreater in the presence of hydrogen to produce a second hydrocarbon product stream and a second sour water stream;

treating the second sour water stream in a first sour water treatment unit to produce a first $NH_3$-rich stream and a first $H_2S$-rich stream;

removing impurities such as residual $H_2S$ from the first $NH_3$-rich stream in an ammonia purification unit to produce cleaned $NH_3$; and treating the flue gas stream with the cleaned $NH_3$ to remove the $SO_2$ in the flue gas in the form of ammonium sulfate prior to releasing the flue gas into the atmosphere.

In one embodiment, the bitumen upgrading process further comprises:

treating the first sour water stream in a second sour water treatment unit to produce a second $NH_3$-rich stream and a second $H_2S$-rich stream;

hydrotreating the second $NH_3$-rich stream in a second hydrotreater in the presence of hydrogen to remove odiferous compounds such as pyridines, indoles, ketones and mercaptans and produce a treated $NH_3$-rich stream; and removing impurities such as residual $H_2S$ from the treated $NH_3$-rich stream in the ammonia purification unit to produce cleaned $NH_3$.

In one embodiment, the treated $NH_3$-rich stream is first treated in the first sour water treatment unit prior to ammonia purification in the ammonia purification unit.

In one embodiment, the bitumen upgrading process further comprises:

treating the first sour water stream in a second sour water treatment unit to produce a second $NH_3$-rich stream and a second $H_2S$-rich stream;

combining the second $NH_3$-rich stream with the first hydrocarbon product stream prior to hydrotreatment in the first hydrotreater to remove odiferous compounds such as pyridines, indoles, ketones and mercaptans.

DESCRIPTION OF THE DRAWINGS

The foregoing and other features of the application will become apparent to those skilled in the art to which the present application relates upon reading the following description with reference to the accompanying drawings, in which.

DESCRIPTION OF THE PREFERRED EMBODIMENTS

Figure 1:
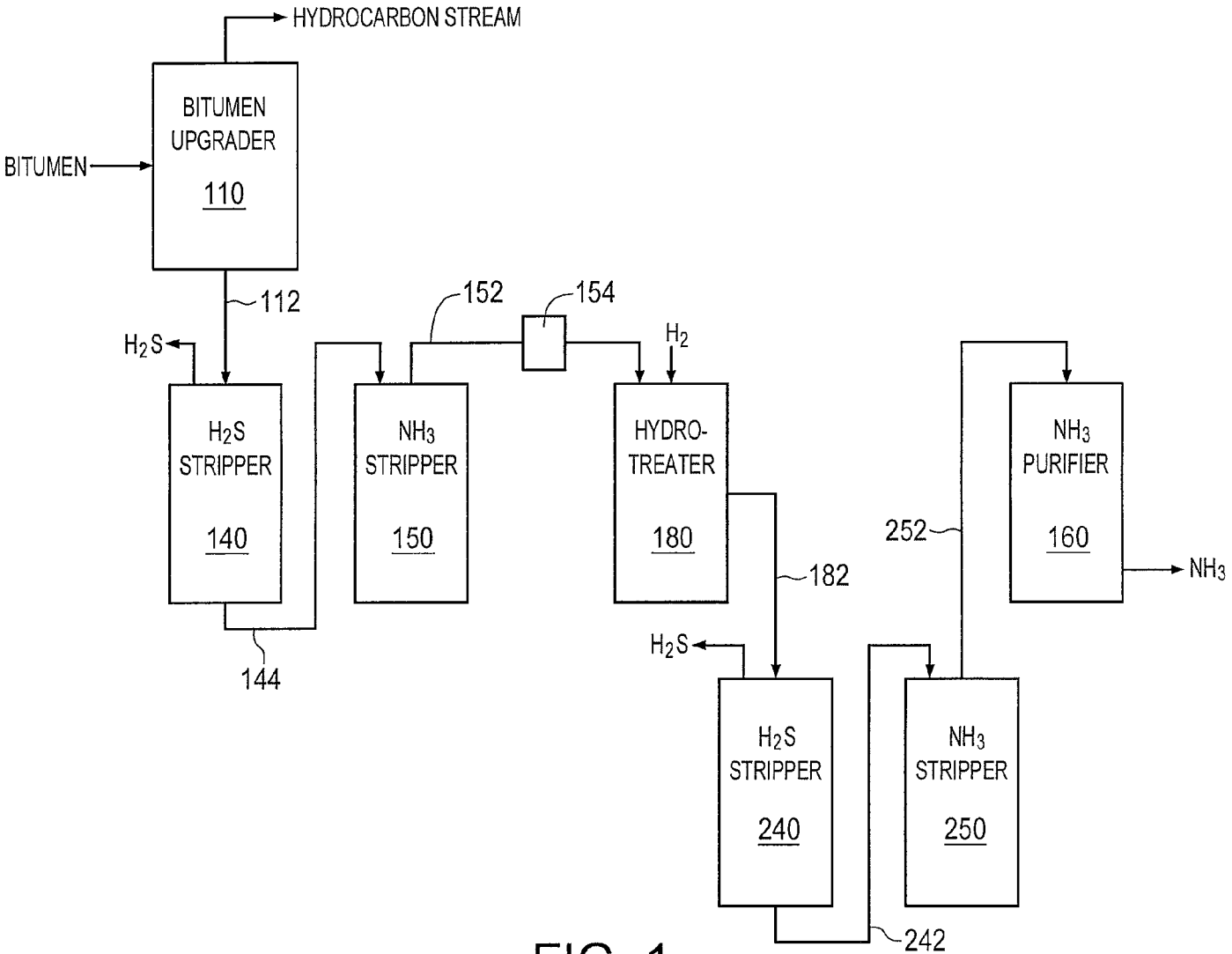
FIG. 1 is a schematic flow diagram showing an embodiment of a method for recovering $NH_3$ present in a sour water stream containing odiferous compounds such as pyridines, indoles, ketones and mercaptans produced in a bitumen upgrader.

It was initially thought that both the sour water stream from a fluid coking reactor and the sour water stream from a hydrocarbon hydrotreater could be used to produce the ammonia for use in treating flue gas produced during fluid coking. However, when both sour water streams were combined, the ammonia obtained therefrom produced a very strong and very foul odor when used to treat the flue gas prior to its released into the atmosphere. It was discovered that the foul odor was caused by 4-mercapto-4-methyl-2-pentanone, also known as "cat-ketone". This compound has a very potent off-odor which resembles the smell of cat urine. Parts per million (ppm) quantities of 4-mercapto-4-methyl-2-pentanone released into the atmosphere can be detected as far as 20 km from the source.

Further studies by the present applicant determined that the originating source of the 4-mercapto-4-methyl-2-pentanone was the sour water stream from the fluid coking reactor. Significant levels of both acetone and 4-mercapto-4-methyl-2-pentanone were detected in this sour water stream. Further, it was discovered that these ketones, and, in particular, 4-mercapto-4-methyl-2-pentanone, were being carried over into $NH_3$-rich streams that were produced when the sour water was treated in a sour water treatment unit. Thus, when the $NH_3$ was further purified in a $NH_3$ purifier for use in treating flue gas, the resultant ammonia was also found to be contaminated with 4-mercapto-4-methyl-2-pentanone. Without being bound to theory, it is believed that the acetone present in the sour water stream is eventually converted into 4-mercapto-4-methyl-2-pentanone as follows:

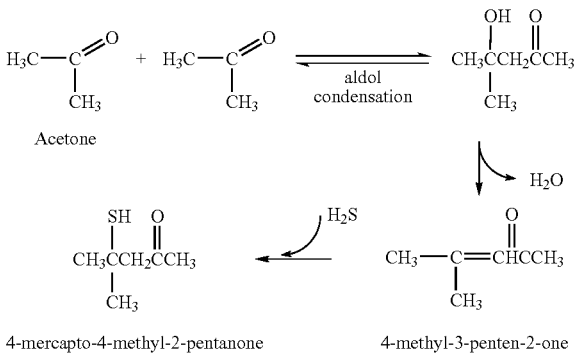

Thus, use of sour water from the coker reactor for ammonia production resulted in ammonia contaminated with 4-mercapto-4-methyl-2-pentanone. However, if the $NH_3$-rich stream is first treated in a hydrotreater in the presence of hydrogen, the resultant treated $NH_3$-rich stream could then be used to produce ammonia essentially free from odorous ketones such as 4-mercapto-4-methyl-2-pentanone. The reducing hydrogen in the presence of a catalyst may convert the ketones into alcohols, thereby destroying any acetone, which can be converted into 4-mercapto-4-methyl-2-pentanone, and any 4-mercapto-4-methyl-2-pentanone that may already be present, hence, eliminating the odor problem. In the alternative, ketones present may be converted to water and a residual hydrocarbon.

On the other hand, tests on the sour water stream produced during treatment of a hydrocarbon stream in a hydrotreater showed that little or no acetone and/or 4-mercapto-4-methyl-2-pentanone was detectable. This is likely due to the fact that any acetone present would be destroyed during the hydrotreating process prior to being converted to 4-mercapto-4-methyl-2-pentanone and that any 4-mercapto-4-methyl-2-pentanone present would also be destroyed during hydrotreating. Thus, it was discovered that only the first sour water stream from the coker reactor resulted in contaminated ammonia which produced the foul odor when used to treat flue gas prior to its release.

Hence, it was discovered that in order to use certain sour water streams produced during bitumen upgrading to produce ammonia without a cat urine-like odor, one must either first hydrotreat the ammonia obtained from sour water (i.e., sour water produced from a fluid coking unit or a catalytic cracker) or only use sour water streams produced from a hydrotreater, which is substantially free of 4-mercapto-4-methyl-2-pentanone, to produce ammonia, or both. The ammonia thus obtained could then be used in flue gas desulfurization, without causing the problem of the strong cat urine-like odor being released into the atmosphere.

FIG. 1 is a schematic flow diagram showing an embodiment of the invention. In particular, FIG. 1 is a schematic of a method for recovering $NH_3$ present in a sour water stream containing ketones produced during an upgrading process for upgrading bitumen from oil sands into synthetic crude. Bitumen is fed into bitumen upgrader 110, which upgrader can be a fluid coking unit, a catalytic cracker, or the like. Sour water 112, which contains ketones such as acetone, 4-mercapto-4-methyl-2-pentanone, or both, is then treated in a sour water treatment unit to separate the $H_2S$ from the $NH_3$ present therein.

The sour water treatment unit comprises a first stage stripper, $H_2S$ stripper vessel 140, and a second stage stripper, ammonia ($NH_3$) stripper vessel 50. $H_2S$ stripper vessel 140 is a steam-reboiled distillation column which distills the sour water 112 to produce a $H_2S$-rich vapor stream 142 and a stripped sour water stream 144, the bottoms stream containing all of the ammonia. Stripped sour water stream 144 is then fed into ammonia stripper vessel 150, which is a refluxed distillation column. Ammonia stripper vessel 150 then distills the stripped sour water stream 144 to produce an ammonia-rich vapor stream 152. It is understood that other methods could be used for removing ammonia and $H_2S$ from sour water, for example, the process disclosed in U.S. Pat. No. 4,486,299, incorporated herein by reference.

The ammonia-rich vapor stream 152 is then condensed in condenser 154 prior to being hydrotreated in hydrotreater 180 in the presence of hydrogen and a catalyst as known in the art, for example, CoMo and NiMo, to produce treated ammonia-rich stream 182. Treated ammonia-rich stream 182, which has been scrubbed from the gas phase with water, is optionally treated in another conventional sour water treatment unit, for example, by first treating it in $H_2S$ stripper 240 to remove $H_2S$ and then in $NH_3$ stripper 250. The further treated ammonia-rich stream 252 is then purified in $NH_3$ purifier 160. The $NH_3$ purifier can be a one- or two-stage scrubbing system which removes any residual $H_2S$ and other impurities.

Figure 2:
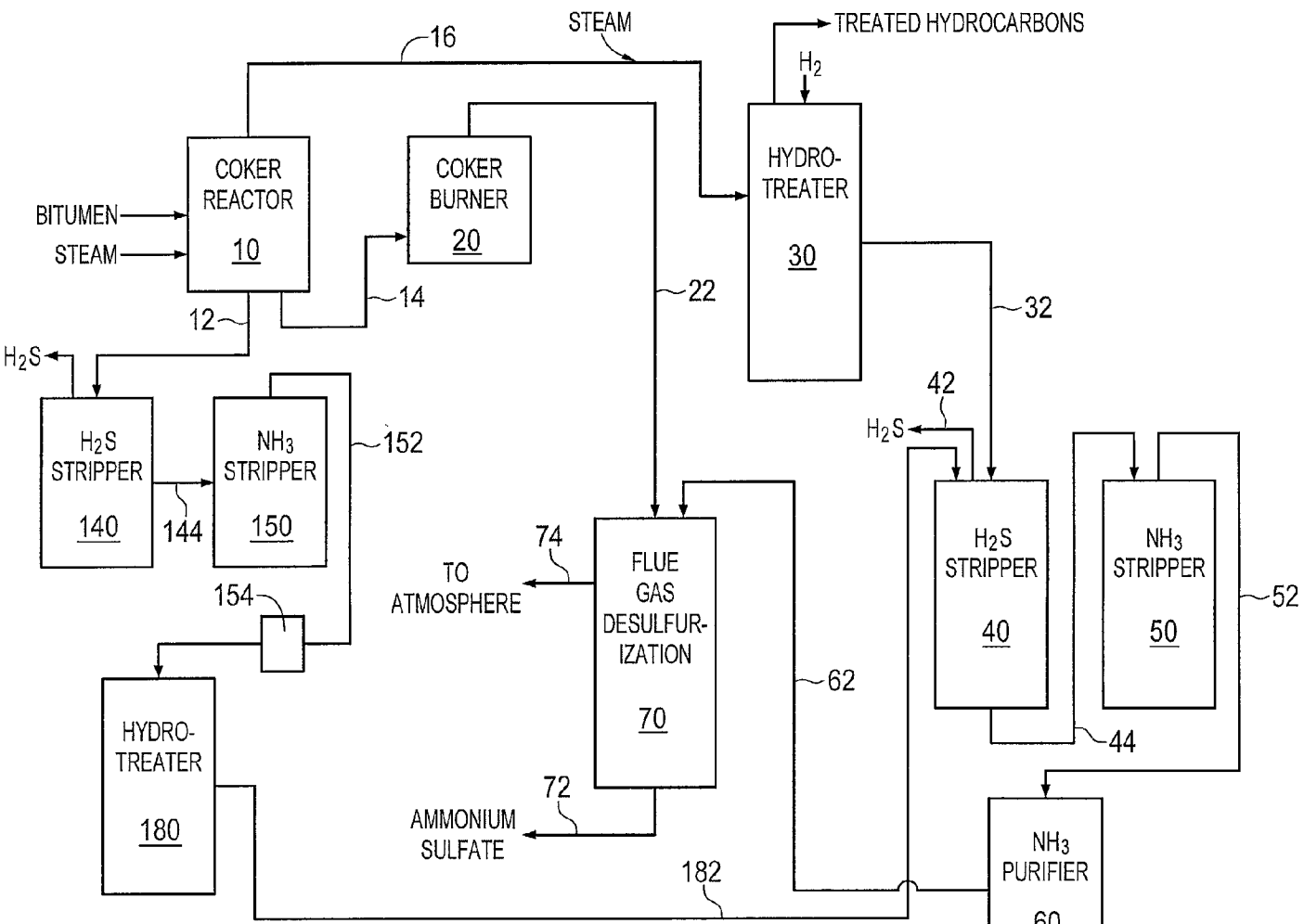
FIG. 2 is a schematic flow diagram of a bitumen upgrading process of the present invention which incorporates the method for recovering $NH_3$ as shown in FIG. 1.

FIG. 2 is a schematic of a typical bitumen upgrading process showing how ammonia obtained in the present invention can be used to treat flue gases produced during fluid coking. Bitumen obtained from oil sand and steam is introduced into the pyrolysis or coking zone of fluid coker reactor 10, which contains fluidized solids such as coke particles so that the bitumen is heated to form vaporized liquid oil products. The vaporized products are passed through a cyclone (not shown) to remove entrained solids which are returned to the coking zone. The vapors leave the cyclone and pass into a scrubber region (not shown) of the coker reactor 10 and coker hydrocarbon product stream 16 is removed for further upgrading. Also produced in the fluid coking process in coker reactor 10 is sour water 12, which contains a high concentration of ammonia and hydrogen sulfide ($H_2S$).

Coke produced in coker reactor 10 is deposited on the fluidized solids (e.g., coke particles) present therein and the coked solids 14 are then heated in coker burner 20 in the presence of oxygen to form hot coked solids. The hot solids from the coker burner are introduced into fluid coker 10 to supply heat for the pyrolysis of bitumen (not shown). Also produced in the coker burner is flue gas, which contains high levels of $SO_2$.

The coker hydrocarbon product stream 16, which still contains a substantial amount of sulfur and nitrogen, is further upgraded in a hydroprocessor, for example, hydrotreater 30, where $H_2$ and catalysts, such as CoMo, NiMo, and zeolites, are added to hydrogenate aromatic hydrocarbons and remove the sulfur and nitrogen containing heteroaromatic hydrocarbons to yield a treated hydrocarbon stream containing reduced sulfur and nitrogen. The hydrotreater sour water 32, which contains the $H_2S$ and ammonia separated from the hydrotreating reaction effluent, is further treated to remove $H_2S$ and ammonia in a sour water treatment unit.

In the embodiment shown in FIG. 2, the sour water treatment unit comprises a first stage stripper, $H_2S$ stripper vessel 40 and a second stage stripper, ammonia ($NH_3$) stripper vessel 50. $H_2S$ stripper vessel 40 distills the sour water 32 to produce an $H_2S$-rich vapor stream 42 and a stripped sour water stream 44. Stripped sour water stream 44 is then fed directly into ammonia stripper vessel 50. Ammonia stripper vessel 50 then distills the stripped sour water stream 44 to produce an ammonia-rich vapor stream 52.

The ammonia-rich vapor stream 52 from ammonia stripper vessel 50 is then sent to ammonia purification unit 60. Ammonia purification unit 60 may comprise a first stage water scrubber and a second stage water scrubber, where the ammonia-rich vapor stream is further stripped of residual $H_2S$ and other contaminants such as mercaptanes to produce cleaned ammonia 62. It is understood that other ammonia purification units and processes known in the art could be used.

The cleaned ammonia 62 can then be used to remove $SO_2$ from the flue gas 22 produced in coker burner 20 by using a gas-liquid contactor or other type of flue gas scrubber in a process commonly referred to as wet flue gas desulfurization (see, for example, Canadian Patent Nos. 2,343,640, 2,116,949, 2,344,494, 2,384,872, 2,371,004 and 2,180,110, incorporated herein by reference). Thus, with reference to FIG. 2, flue gas 22 and cleaned ammonia 52 are each fed into gas-liquid contactor 70, where the ammonia is allowed to react with the $SO_2$ to produce ammonium sulfate. The ammonium sulfate is a valuable product which can be used as a fertilizer and the like.

As in FIG. 1, the coker sour water 12 can be treated in $H_2S$ stripper 140 to remove $H_2S$ from the sour water and produce stripped sour water stream 144. Stripped water stream 144 is fed into $NH_3$ stripper vessel 150 to produce ammonia-rich vapor stream 152. Ammonia-rich vapor stream 152 is then condensed in condenser 154 prior to hydrotreatment in hydrotreater 180. It is understood, however, that condensed ammonia-rich vapor stream 152 could also be combined with first hydrocarbon stream 16 and hydrotreated in hydrotreater 30.

Treated ammonia-rich stream 182 is optionally then treated in $H_2S$ stripper 40 and $NH_3$ stripper 50 prior to being purified in $NH_3$ purifier 60. In the alternative, ammonia-rich stream 182 can be fed directly into ammonia purification unit 60.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A method for recovering $NH_3$ present in a sour water stream containing odiferous compounds comprising pyridines, indoles, ketones and mercaptans produced during an upgrading process for upgrading bitumen from oil sands into synthetic crude, comprising:

(a) subjecting the bitumen to an initial upgrading step comprising either coking in a coker or catalytic cracking in a catalytic cracker to produce the sour water stream containing the odiferous compounds;

(b) treating the sour water stream in a sour water treatment unit to produce a $NH_3$-rich stream, a $H_2S$-rich stream and a treated water stream; and (c) removing the odiferous compounds from the $NH_3$-rich stream to produce cleaned $NH_3$ that is of a sufficient quality to be used in a flue gas desulfurization process without producing a foul odor.

2. The method as claimed in claim 1, wherein the coking operation is a fluid coking operation.

3. The method as claimed in claim 1, wherein the odiferous compounds are removed from the $NH_3$-rich stream by hydrotreating the $NH_3$-rich stream in a hydrotreater in the presence of hydrogen and a catalyst to produce a hydrotreated $NH_3$-rich stream.

4. The method as claimed in claim 3, further comprising:

(d) removing other impurities comprising residual $H_2S$ from the hydrotreated $NH_3$-rich stream in an ammonia purification unit to produce cleaned $NH_3$.

5. The method as claimed in claim 1, wherein the odiferous compounds are ketones comprising acetone and 4-mercapto-4-methyl-2-pentanone.

6. The method as claimed in claim 4, further comprising:

(e) treating the hydrotreated $NH_3$-rich stream in a second sour water treatment unit prior to purification in the ammonia purification unit.

7. A method for recovering $NH_3$ present in a sour water stream containing odiferous ketones produced during an upgrading process for upgrading bitumen from oil sands into synthetic crude, comprising:

(a) feeding the bitumen to a fluid coking unit comprising a fluidized bed coker, a coke burner and a CO burner, and producing a hydrocarbon product stream, the sour water stream, and a $SO_2$-rich flue gas stream;

(b) treating the sour water stream in a sour water treatment unit to produce a $NH_3$-rich stream containing odiferous ketones, $H_2S$-rich stream and a treated water stream;

(c) hydrotreating the $NH_3$-rich stream in a hydrotreater in the presence of hydrogen to remove the odiferous ketones and produce a hydrotreated $NH_3$-rich stream; and (d) removing other impurities such as residual $H_2S$ from the hydrotreated $NH_3$-rich stream in an ammonia purification unit to produce cleaned $NH_3$;

wherein the cleaned $NH_3$ is of a sufficient quality to be used to treat the $SO_2$-rich flue gas stream in a flue gas desulfurization unit to remove $SO_2$ from the flue gas stream and produce ammonium sulfate without producing a foul odor.

8. The method as claimed in claim 7, wherein the odiferous ketones are acetone, 4-mercapto-4-methyl-2-pentanone, or a combination of acetone and 4-mercapto-4-methyl-2-pentanone.

9. The method as claimed in claim 7, further comprising:

(e) treating the hydrotreated $NH_3$-rich stream in a second sour water treatment unit prior to purification in the ammonia purification unit.

10. A process for upgrading bitumen and recovering cleaned ammonia ($NH_3$) from segregated sour water streams produced during upgrading, said cleaned $NH_3$ being of a sufficient quality to be used in a flue gas desulfurization process without producing a foul odor, comprising:

(a) feeding the bitumen to a fluid coking unit comprising a fluidized bed coker, a coke burner and a CO burner, and producing a first hydrocarbon product stream, a first sour water stream containing odiferous compounds comprising pyridines, indoles, ketones and mercaptans and a $SO_2$-rich flue gas stream;

(b) hydrotreating the first hydrocarbon product stream in a first hydrotreater in the presence of hydrogen to produce a second hydrocarbon product stream and a second sour water stream;

(c) treating the second sour water stream in a first sour water treatment unit to produce a first $NH_3$-rich stream, a first $H_2S$-rich stream and a first treated water stream;

(d) treating the first sour water stream in a second sour water treatment unit to produce a second $NH_3$-rich stream containing the odiferous compounds, a second $H_2S$-rich stream and a second treated water stream;

(e) hydrotreating the second $NH_3$-rich stream containing the odiferous compounds in a second hydrotreater in the presence of hydrogen and a catalyst to remove the odiferous compounds and produce a hydrotreated $NH_3$-rich stream; and (f) removing impurities comprising residual $H_2S$ from the first $NH_3$-rich stream and the hydrotreated $NH_3$-rich stream in an ammonia purification unit to produce cleaned $NH_3$.

11. The process as claimed in claim 10, further comprising:

(g) treating the $SO_2$-rich flue gas stream with the cleaned $NH_3$ to remove the $SO_2$ in the flue gas in the form of ammonium sulfate prior to releasing the flue gas into the atmosphere.

12. The process as claimed in claim 10, wherein the odiferous compounds are ketones comprising acetone and 4-mercapto-4-methyl-2-pentanone.

13. The method as claimed in claim 1, wherein the step of hydrotreating the $NH_3$-rich stream in a hydrotreater further comprises adding a catalyst.

14. The method as claimed in claim 13, wherein the catalyst is CoMo or NiMo.

15. The process as claimed in claim 10, wherein the first hydrotreater and the second hydrotreater are a single hydrotreater.

16. A process for recovering $NH_3$ from sour water streams produced during upgrading of bitumen from oil sands, said $NH_3$ being of a sufficient quality to be used in a flue gas desulfurization process without producing a foul odor, comprising:

(a) feeding the bitumen to a fluid coking unit comprising a fluidized bed coker, a coke burner and a CO burner, and producing a first hydrocarbon product stream, a first sour water stream containing one or more odiferous compounds comprising pyridines, indoles, ketones and mercaptans and a $SO_2$-rich flue gas stream;

(b) hydrotreating the first hydrocarbon product stream in a first hydrotreater in the presence of hydrogen and a catalyst to produce a second hydrocarbon product stream and a second sour water stream;

(c) combining the first sour water stream and the second sour water stream to produce a combined sour water stream and treating the combined sour water stream in a sour water treatment unit to produce a $NH_3$-rich stream containing the one or more odiferous compounds and a $H_2S$-rich stream; and (d) removing the one or more odiferous ketones from the $NH_3$-rich stream to produce a ketone-free $NH_3$-rich stream.

17. The process as claimed in claim 16, further comprising:

(e) removing impurities comprising residual $H_2S$ from the odiferous compound-free $NH_3$-rich stream in an ammonia purification unit to produce cleaned $NH_3$.

18. The process as claimed in claim 16, wherein the catalyst is CoMo or NiMo.

* * * * *